US005215046A

United States Patent [19]

Takenaka et al.

[11] Patent Number: 5,215,046

[45] Date of Patent: Jun. 1, 1993

[54] ROTATIONAL PHASE DIFFERENCE ADJUSTING MEANS

[75] Inventors: Akihiko Takenaka, Anjo; Haruyuki Obata, Toyota, both of Japan

[73] Assignee: Nippondenso Co., Ltd., Kariya, Japan

[21] Appl. No.: 953,668

[22] Filed: Sep. 30, 1992

[30] Foreign Application Priority Data

Oct. 3, 1991 [JP] Japan ..... 3-256354

[51] Int. Cl.[5] ..... F01L 1/34

[52] U.S. Cl. ..... 123/90.17; 123/90.31; 464/2; 464/160

[58] Field of Search ..... 123/90.15, 90.17, 90.31; 464/1, 2, 160

[56] References Cited

U.S. PATENT DOCUMENTS 4,967,701 11/1990 Isogai et al. ..... 123/90.17
5,067,450 11/1991 Kano et al. ..... 123/90.17
5,080,052 1/1992 Hotta et al. ..... 123/90.17
5,090,365 2/1992 Hotta et al. ..... 123/90.17

FOREIGN PATENT DOCUMENTS 2-241914 9/1990 Japan .

*Primary Examiner*—E. Rollins Cross

*Assistant Examiner*—Weilun Lo

*Attorney, Agent, or Firm*—Cushman, Darby & Cushman

[57] ABSTRACT

A rotational phase difference adjusting device for adjusting a rotational phase difference between a first rotational member and a second rotational member, comprises, an input member connected to the first rotational member to be rotated thereby, an output member arranged coaxially with the input member and connected to the second rotational member to rotate it, a differential device for connecting the input member to the output member to be rotated thereby and for generating a difference in rotation between the input member and the output member, and a damping device including a viscous fluid which is arranged between the input member and the output member so that a vibration of a relative movement between the input member and the output member is absorbed by a viscosity of the viscous fluid, and including a sealing device for holding the viscous fluid between the input member and the output member against a slide movement of the sealing device between the input member and the output member, wherein the slide movement of the sealing means is carried out on a plane extending substantially perpendicularly to the axis of the input and output members.

20 Claims, 4 Drawing Sheets

ROTATIONAL PHASE DIFFERENCE ADJUSTING MEANS

BACKGROUND OF THE INVENTION AND RELATED ART STATEMENT

The present invention relates to a rotational phase difference adjusting means which is arranged between two rotational shafts to adjust a rotational phase difference therebetween, and which may be used in an internal combustion engine to change an action phase of each of an intake valve and an exhaust valve according to a condition of the internal combustion engine.

In a conventional valve action phase difference adjusting device disclosed by Publication of Japanese Patent Unexamined Publication No. 2-241914, as shown in FIG. 4, a timing pulley 16 which is driven by a crank shaft of an internal combustion engine through a timing belt is supported on a cam shaft 12 in a rotatable manner through a cylindrical sleeve 16*c* extending from the timing pulley 16. A cylindrical ring gear 22 is arranged between the cylindrical sleeve 16*c* and a damper case 15 which is fixed to the cam shaft 12 to rotate together therewith. The ring gear 22 has helical splines on an inner cylindrical surface and outer cylindrical surface thereof, and the helical splines with respective helical angles relative to an axis of the cam shaft 12 engage with helical splines on an inner surface of the damper case 15 and on an outer surface of the cylindrical sleeve 16*c*, respectively. A torque applied to the pulley 16 is transmitted from the cylindrical sleeve 16*c* to the damper case 15 through the ring gear 22 to drive the ring gear 22. When the ring gear 22 is moved in an axial direction of the cam shaft 12 by a hydraulic force, a relative rotation between the damper case 15 and the cylindrical sleeve 16*c* is generated along the helical splines so that a rotational phase difference between the cam shaft 12 and the pulley 16 is adjusted. The damper case 15 has a combination of a disk portion extending radially and a plurality of tube-shaped projections therefrom on an outer periphery thereof. A viscous damper 17 is formed between the tube-shaped projections and a plurality of labyrinth grooves receiving the tube-shaped projections in the pulley 16. A viscous fluid of the viscous damper 17 is received in a sealing manner by a space formed by the pulley 16, the damper case 15 and a cover 18 fixed to the pulley 16. A shearing force generated between the tube-shaped projections and the labyrinth grooves according to the relative rotation between the damper case 15 and the pulley 16 decelerates or absorbs a vibration of the ring gear 22 and/or the cam shaft 12. Oil-seats 19 and 21 prevent the viscous fluid from flowing oil from the space among the pulley 16, the damper case 15 and the cover 18.

OBJECT AND SUMMARY OF THE INVENTION

An object of the present invention is to provide a rotational phase difference adjusting means whose damping force for absorbing a vibration of rotational phase can be kept at a desired degree.

According to the present invention, a rotational phase difference adjusting means for adjusting a rotational phase difference between a first rotational member and a second rotational member, comprises, an input member connected to the first rotational member to be rotated thereby, a output member arranged coaxially with the input member and connected to the second rotational member to rotate it, a differential means for connecting the input member to the output member to be rotated thereby and for generating a difference in rotation between the input member and the output member, and a damping means including a viscous fluid which is arranged between the input member and the output member so that a vibration of a relative movement between the input member and the output member is absorbed by a viscosity of the viscous fluid, and including a sealing means for holding the viscous fluid between the input member and the output member against a slide movement of the sealing means between the input member and the output member, wherein the slide movement of the sealing means is carried out on a plane extending substantially perpendicularly to the axis of the input and output members.

In the rotational phase difference adjusting means according to the present invention, since the slide movement of the sealing means which holds the viscous fluid between the input member and the output member against the slide movement of the sealing means relative to either of the input and output members is carried out on the plane extending substantially perpendicularly to the axis of the input and output members, the slide movement of the sealing means relative to either of the input and output members does not occur and a rigidity of the sealing means may be small when the input and output members to be arranged in a radial direction thereof are being combined with each other in the axial direction of the input and output members. Since the rigidity of the sealing means may be small, a frictional force generated by the slide movement of the sealing means does not affect largely the relative movement between the input member and the output member and does not change largely a degree of the absorption of the vibration of the relative movement between the input member and the output member.

DETAILED DESCRIPTION OF PREFERRED EMBODIMENTS

A rotational phase difference adjusting apparatus according to the present invention may be applied to an intake valve cam shaft, an exhaust valve cam shaft, a double overhead camshaft engine, a single overhead camshaft engine, or a shaft driven through a belt, chain, or thoothed gear.

Figure 1:
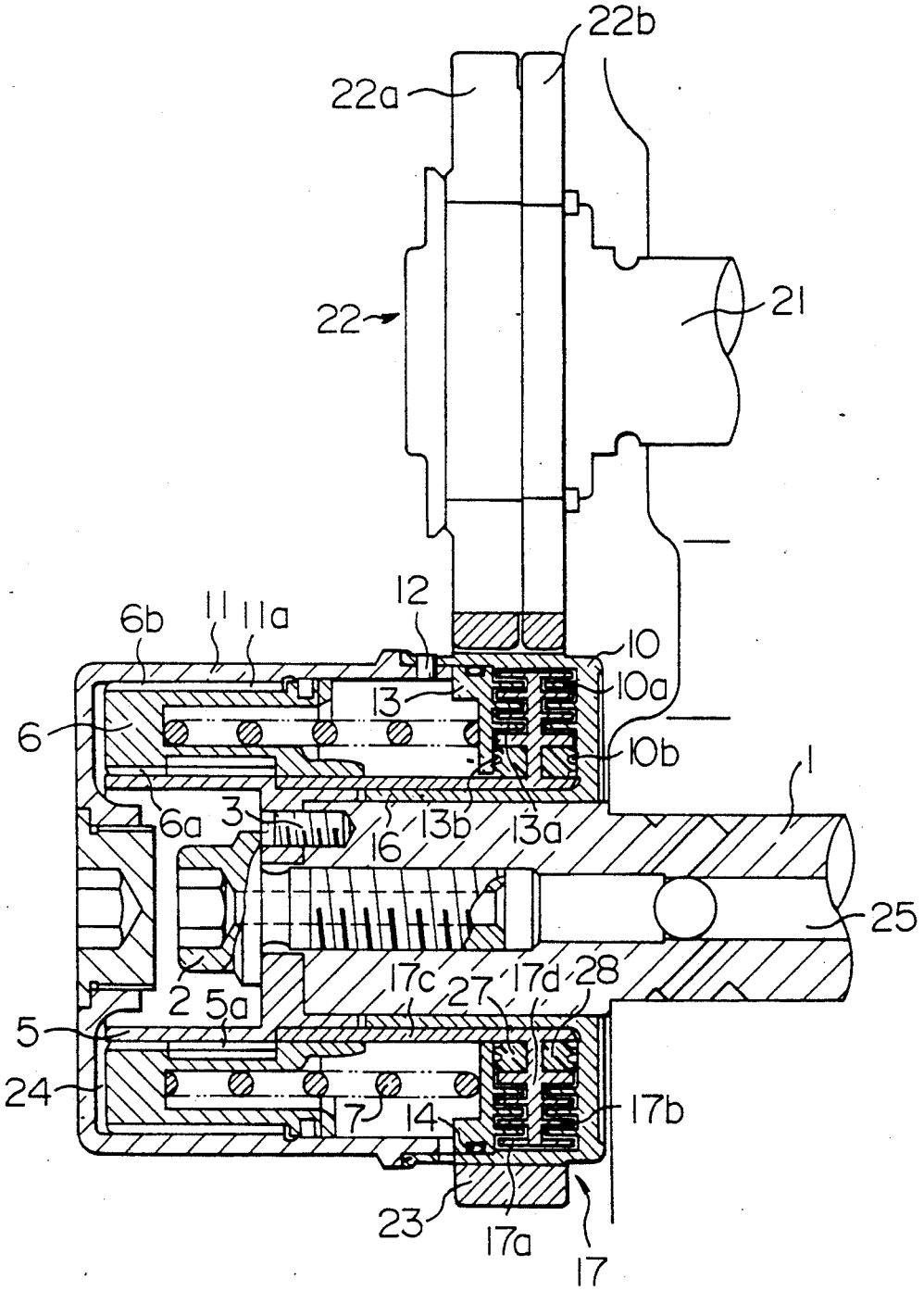
FIG. 1 is a partially cross-sectional view showing an embodiment of rotational phase difference adjusting apparatus according to the present invention.

As shown in FIG. 1, in a first embodiment of the present invention, an exhaust valve cam shaft 21 for driving an exhaust valve of an internal combustion chamber is driven by a crank shaft of internal combustion engine (not shown) through a timing pulley or the like (not shown), and an intake valve cam shaft 1 is driven by a timing gear 22 fixedly mounted on the exhaust valve cam shaft 21 through a timing gear 23 mounted on the intake valve cam shaft 1. The timing gear 22 is formed by a pair of gears 22*a* and 22*b* so that each of teeth of the timing gear 23 is nipped or engaged closely by a tooth of the gear 22*a* and a tooth of the gear 22*b* to eliminate a backlash between the timing gear 23 and the timing gear 22.

A cam gear housing 10 is supported on the intake valve cam haft 1 in a rotatable manner through a sleeve 16 which extends at a central portion of the cam gear housing 10 and is fitted on the intake valve cam shaft 1 in a rotatable manner. The cam gear housing 10 has the timing gear 23 on an outer periphery thereof and a viscous damper 17. A tubular shaft 5 is fixedly connected to a forward end of the intake valve cam shaft 1 by a pin 3 and a bolt 2 so that the tubular shaft 5 rotates together with the intake valve cam shaft 1. A cap-shaped housing 11 is arranged at an outside of the tubular shaft 5 and is fixedly connected to the cam gear housing 10 by a plurality of pins 12 so that the cap-shaped housing 11 rotates together with the cam gear housing 10.

An outer periphery of the tubular shaft 5 has a helical spline (outer teeth) 5*a*, and an inner periphery of the cap-shaped housing 11 has a helical spline (inner teeth) 11*a*. A ring gear 6 is arranged between the tubular shaft 5 and the cap-shaped housing 11, and an inner helical spline 6*a* and outer helical spline 6*b* of the ring gear 6 engage with the helical splines 5*a* and 11*a*, respectively. A helical angle of the helical spline 5*a* and the inner helical spline 6*a* is different from that of the helical spline 11*a* and the outer helical spline 6*b* so that an axial movement of the ring gear 6 generates a rotational relative movement between the tubular shaft 5 and the cap-shaped housing 11 or between the intake valve cam shaft 1 and the exhaust valve cam shaft 21. A hydraulic chamber 24 is formed between the cap-shaped housing 11 and the ring gear 6 and is connected fluidly to a hydraulic pressure source (not shown) by a hydraulic path 25 formed in the intake valve cam shaft 1. The ring gear 6 is urged toward the hydraulic chamber 24 by a spring 7.

When a normal operation mode is selected, or the ring gear 6 is not being driven toward the forward end of the intake valve cam shaft 1, the intake valve cam shaft 1 is driven only by the exhaust valve cam shaft 21 to rotate synchronously therewith through the gear 22 of the exhaust valve cam shaft 21, the gear 23 of the cam gear housing 10, the helical spline 11*a* of the cap-shaped housing 11, the outer helical spline 6*b* of the ring gear 6, the inner helical spline 6*a* of the ring gear 6, and the helical spline 5*a* of the tubular shaft 5.

When a valve timing changing (valve action phase changing) mode is selected, or the ring gear 6 is being driven toward the forward end of the intake valve cam shaft 1 against the spring 7, the hydraulic pressure is applied t the hydraulic chamber 24 through the hydraulic path 25. The difference between the helical angle of the helical spline 5*a* and the inner helical spline 6*a* and the helical angle of the helical spline 11*a* and the outer helical spline 6*b* with the axial movement of the ring gear 6 toward the forward end of the intake valve cam shaft 1 generates the rotational relative movement between the tubular shaft 5 and the cap-shaped housing 11 or between the intake valve cam shaft 1 and the exhaust valve cam shaft 21. When the hydraulic pressure in the hydraulic chamber 24 is being discharged through the hydraulic path 25, the axial movement of the ring gear 6 away from the forward end of the intake valve cam shaft 1 by the spring 7 generates in a reverse direction relative to the above direction the rotational relative movement between the tubular shaft 5 and the cap-shaped housing 11 or between the intake valve cam shaft 1 and the exhaust valve cam shaft 21.

The viscous damper 17 fixedly mounted on the intake valve cam shaft 1 through the tubular shaft 5 is juxtaposed with the ring gear 6 and the cap-shaped housing 11 in an axial direction of the intake valve cam shaft 1 in a radially inside of the gear 23. The viscous damper 17 is received in an annular space of the cam gear housing 10 opening toward the forward end of the intake valve cam shaft 1, and has a cylindrical sleeve 17*c*, a disk 17*d* extending radially from the cylindrical sleeve 17*c*, and a plurality of tube-shaped projectionbbs 17*a*, 17*b* extending coaxially with the intake valve cam shaft 1 on both sides of the disk 17*d*. An inner surface 10*b* of the cam gear housing 10 includes a plurality of ring-shaped projections 10*a* extending coaxially with the intake valve cam shaft 1 to form a plurality of grooves for receiving the tube-shaped projections 17*a*, 17*b*. The cylindrical sleeve 17*c* is supported on the sleeve 16 of the cam gear housing 10 in a rotatable manner, and is fixed to the tubular shaft 5 by a pin (not shown).

A cover 13 fixed to the cam gear housing 10 covers the annular space of the cam gear housing 10 receiving the viscous damper 17, and has a plurality of ring-shaped projections 13*a* extending coaxially with the intake valve cam shaft 1 to form a plurality of grooves for receiving the tube-shaped projections 17*a*, 17*b*. An O-ring 14 between the cover 13 and the cam gear housing 10 prevents the viscous fluid from flowing out from the annular space.

Figure 2:
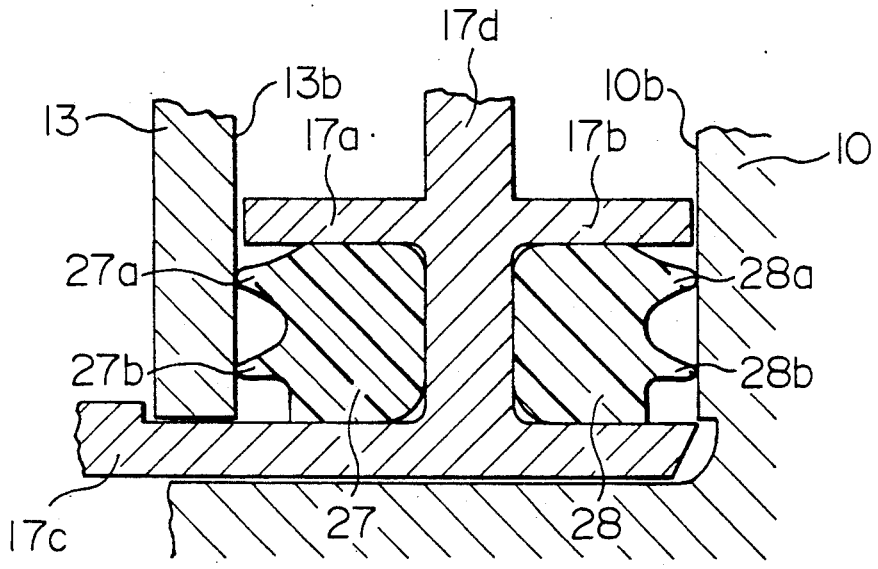
FIG. 2 is an enlarged cross-sectional view showing a sealing structure of the embodiment shown in FIG. 1.

As shown in FIG. 2, an oil-seal 27 between the viscous damper 17 and a contact plane 13*b* of the cover 13 extending perpendicularly to the axis of the intake valve cam shaft 1 and an oil-seal 28 between the viscous damper 17 and a contact plane 10*b* of the cam gear housing 10 extending perpendicularly to the axis of the intake valve cam shaft 1 prevent the viscous fluid from flowing out from the annular space. The oil-seal 27 has lip portions 27*a* and 27*b* which slide on the contact plane 13*b* to prevent the viscous fluid from flowing out from the annular space and an engine oil from flowing into the annular space, and the oil-seal 28 has lip portions 28*a* and 28*b* which slide on the contact plane 10*b* to prevent the viscous fluid from flowing out from the annular space and an engine oil from flowing into the annular space, The oil-seal 27 and 28 may be received by the cover 13 and the cam gear housing 10, respectively, and the lip portions 27*a*, 27*b* and 28*a*, 28*b* may slide on respective contact planes of the disk 17*d* extending perpendicularly t the axis of the intake valve cam shaft 1 so that the viscous fluid is prevented from flowing out from the annular space and the engine oil is prevented from flowing into the annular space.

When the viscous damper 17 is set in the cam gear housing 10, firstly, the oil-seals 27 and 28 are mounted in the most radially inner portion of the disk 17*d* among the tube-shaped projections 17*a*, 17*b* and the sleeve 17*c*. Subsequently, the sleeve 17*c* is mounted on the sleeve 16 in a rotatable manner, and thereafter, the cover 13 is set in the cam gear housing 10 and the sleeve 17*c* is fixed to the tubular shaft 5. Finally, the cover 13 is pressed against the cam gear housing 10 to be fixed thereto by the cap-shaped housing 11 after the ring gear 6 and the spring 7 are set on the tubular shaft 5.

Since the contact planes 10*b* and 13*b* extend perpendicularly to the axis of the intake valve cam shaft 1, the lip portions 27*a*, 27*b* and 28*a*, 28*b* do not slide on the contact planes 10*b* and 13*b* when the viscous damper 17 is mounted on the intake valve cam shaft 1 to be juxtaposed with the ring gear 6 and the cap-shaped housing 11 in an axial direction of the intake valve cam shaft 1, so that the lip portions 27*a*, 27*b* and 28*a*, 28*b* are not damaged on the assembling of the rotational phase difference adjusting apparatus and a rigidity of each of the lip portions 27*a*, 27*b* and 28*a*, 28*b* may be small. Since the oil-seals 27 and 28 are arranged on an outer periphery of the sleeve 17*c* to reduce sliding diameters of the oil-seals 27 and 28 and the rigidity of each of the lip portions 27*a*, 27*b* and 28*a*, 28*b* is small, a frictional force generated by the sliding between the oil-seals 27 and 28 and the contact planes 10*b* ad 13*b* can be decreased largely so that a hydraulic pressure through the hydralic path 25 and a spring force of the spring 7 for driving the ring gear 6 may be small with a secure operation of the rotational phase difference adjusting apparatus.

Figure 3:
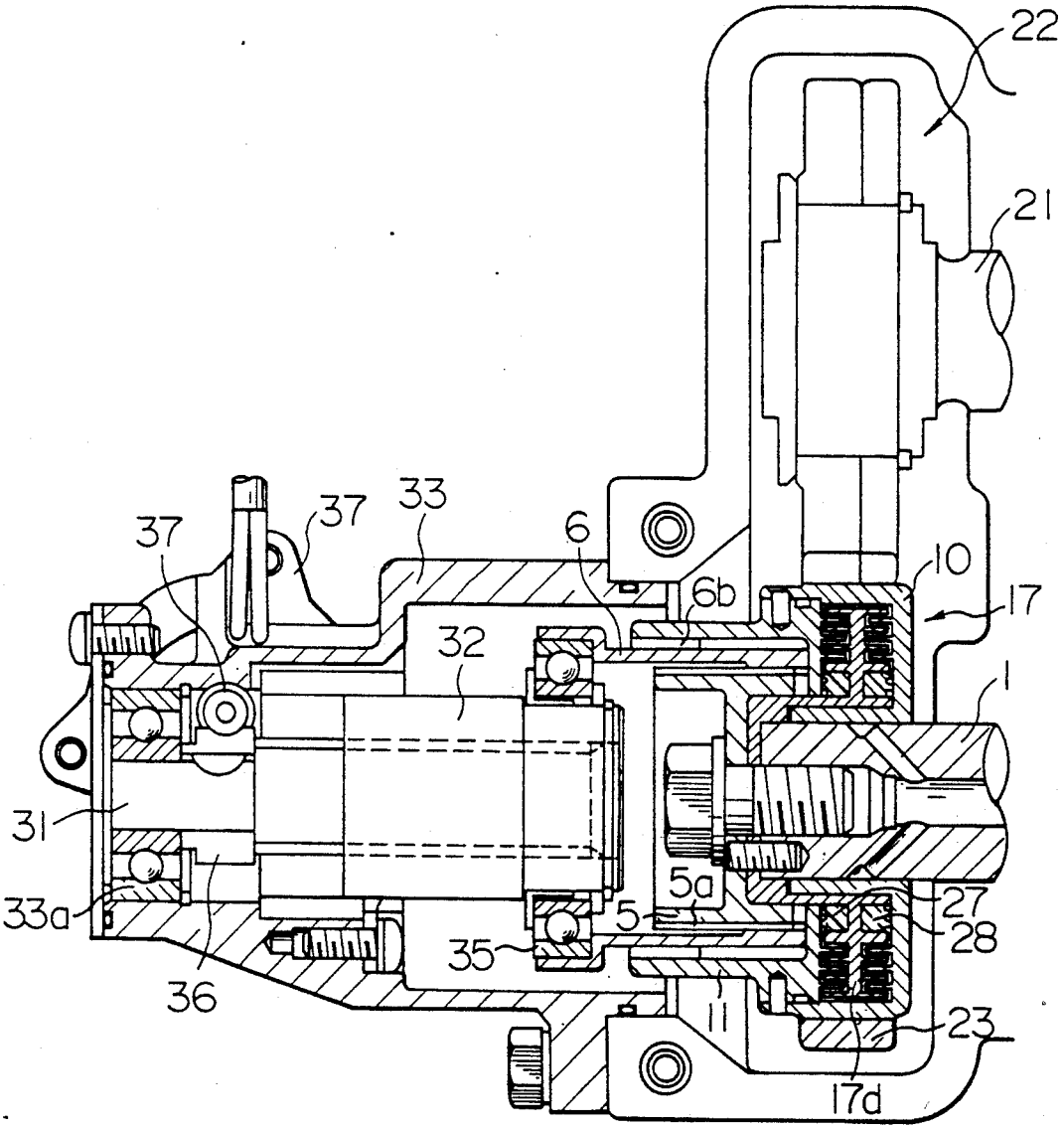
FIG. 3 is a partially cross-sectional view showing another embodiment of rotational phase difference adjusting apparatus according to the present invention.
Figure 4:
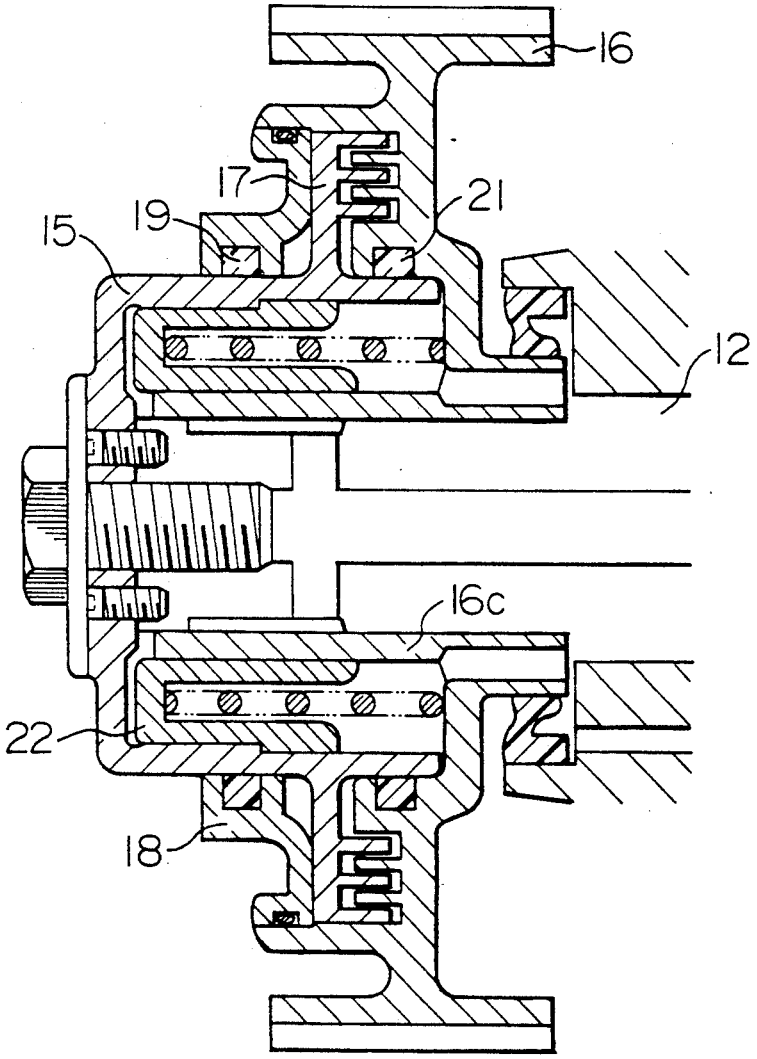
FIG. 4 PRIOR ART
FIG. 4 is a partially cross-sectional view showing a prior-art rotational phase difference adjusting apparatus.

In a second embodiment of the present invention shown in FIG. 3, the ring gear 6 is driven by a combination of a electric motor and a worm gear. A ball-screw shaft 31 is supported on a housing 33 in a rotatable manner through a ball-bearing 33*a* and its axial movement is prevented. A ball-nut 32 is moveable in an axial direction of the ball-screw shaft 31 in the housing 32 and its rotational movement is prevented by the a sliding key way (not shown). The ring gear 6 is connected to the ball-nut 32 in a rotatable manner through a ball-bearing 35 and moves together with the ball-nut 32 in the axial direction of the ball-screw shaft 31 to generate a difference in rotation between the intake valve cam shaft 1 and the exhaust valve cam shaft 21. A worm wheel 36 surrounding the ball-screw shaft 31 engages with a worm gear 37 connected to an output shaft of an electric motor. When the electric motor is energized to rotate the worm gear 37, the ball-screw shaft 31 is rotated through the worm wheel 36. Since a rotation of the ball-nut 32 is prevented, the ball-nut 32 proceeds in the axial direction of the ball-screw shaft 31 so that the ring gear 6 is moved by the ball-nut 32 to adjust a rotational phase difference between the intake valve cam shaft 1 and the exhaust valve cam shaft 21. Since the sliding diameters of the oil-seals 27 and 28 are small as the first embodiment of the present invention, the force generated by the electric motor may be small.

What is claimed is:

1. A rotational phase difference adjusting means for adjusting a rotational phase difference between a first rotational member and a second rotational member, comprising, an input member connected to the first rotational member to be rotated thereby, an output member arranged coaxially with the input member and connected to the second rotational member to rotate it, a differential means for connecting the input member to the output member to be rotated thereby and for generating a difference in rotation between the input member and the output member, and a damping means including a viscous fluid which is arranged between the input member and the output member so that a vibration of a relative movement between the input member and the output member is absorbed by a viscosity of the viscous fluid, and including a sealing means for holding the viscous fluid between the input member and the output member against a slide movement of the sealing means between the input member and the output member, wherein the slide movement of the sealing means is carried out on a plane extending substantially perpendicularly to the axis of the input and output members.

2. A rotational phase difference adjusting means according to claim 1, wherein the plane is included by the input member.

3. A rotational phase difference adjusting means according to claim 1, wherein the plane is included by the output member.

4. A rotational phase difference adjusting means according to claim 1, wherein the sealing means is juxtaposed with the differential means in an axial direction of the input and output members so that the sealing means is not arranged at a radially outer side of the differential means.

5. A rotational phase difference adjusting means according to claim 1, wherein the rotational phase difference adjusting means includes an annular space extending in an axial direction of the input and output members between the input member and the output member, the differential mean is arranged at an end of the annular space, and the damping means is arranged at another end of the annular space.

6. A rotational phase difference adjusting means according to claim 1, wherein the rotational phase difference adjusting means includes a space extending in a radial direction of the input and output members between the input member and the output member, and the space receives the viscous fluid of the damping means.

7. A rotational phase difference adjusting means according to claim 1, wherein the rotational phase difference adjusting means includes a space extending in an axial direction of the input and output members between the input member and the output member, and the space receives the viscous fluid of the damping means.

8. A rotational phase difference adjusting means according to claim 1, wherein the sealing means is fixed to the input member.

9. A rotational phase difference adjusting means according to claim 1, wherein the sealing means is fixed to the output member.

10. A rotational phase difference adjusting means according to claim 1, wherein the differential means is supported on the output member.

11. A rotational phase difference adjusting means according to claim 1, wherein the differential means is arranged at an axial end of the output member, and the damping means is arranged at an axially inner side of the differential means.

12. A rotational phase difference adjusting means according to claim 1, wherein the differential means includes a first spline arranged on the input member, a second spline arranged on the output member, a moveable spline means having splines engaging with the first spline and the second spline, respectively, and a driving means for driving the moveable spline means in an axial direction of the input and output members, and an angle between the first spline and the axial direction of the input and output members is different from an angle between the second spline and the axial direction of the input and output members so that the differential rotation between the input member and the output member is generated by an axial movement of the moveable spline means.

13. A rotational phase difference adjusting means according to claim 12, wherein the driving means is a fluidal pressure actuator.

14. A rotational phase difference adjusting means according to claim 12, wherein the driving means is an electric motor.

15. A rotational phase difference adjusting means according to claim 12, wherein the driving means has an electric rotational motor and a convertor for converting a rotation of the electric rotational motor to the axial movement for the moveable spline means.

16. A rotational phase difference adjusting means according to claim 12 wherein the moveable spline means is rotatable in relation to the input and output members.

17. A valve action phase adjusting means for adjusting a rotational phase difference between a crank shaft of an internal combustion engine and a cam shaft thereof, comprising, an input member connected to the crank shaft to be rotated thereby, an output member arranged coaxially with the input member and connected to the cam shaft to rotate it, a differential means for connecting the input member to the output member to be rotated thereby and for generating a difference in rotation between the input member and the output member, and a damping means including a viscous fluid which is arranged between the input member and the output member so that a vibration of a relative movement between the input member and the output member is absorbed by a viscosity of the viscous fluid, and including a sealing means for holding the viscous fluid between the input member and the output member against a slide movement of the sealing means between the input member and the output member, wherein the slide movement of the sealing means is carried out on a plane extending substantially perpendicularly to the axis of the input and output members.

18. A rotational phase difference adjusting means according to claim 17, wherein the differential means is supported on the cam shaft.

19. A rotational phase difference adjusting means according to claim 17, wherein the differential means is arranged at an axial end of the output member, and the damping means is arranged at a axially inner side of the differential means.

20. A rotational phase difference adjusting means according to claim 17, wherein the output member is supported on the cam shaft.

* * * * *